US006554724B2

(12) United States Patent
Taylor

(10) Patent No.: US 6,554,724 B2
(45) Date of Patent: Apr. 29, 2003

(54) ACTION-RESPONSIVE BASKETBALL BACKBOARD

(76) Inventor: Carl Taylor, 4806 S. 184th Plz., Omaha, NE (US) 68138

( * ) Notice: Subject to any disclaimer, the term of this patent is extended or adjusted under 35 U.S.C. 154(b) by 0 days.

(21) Appl. No.: 09/982,725

(22) Filed: Oct. 18, 2001

(65) Prior Publication Data

US 2002/0049102 A1 Apr. 25, 2002

Related U.S. Application Data

(60) Provisional application No. 60/241,586, filed on Oct. 19, 2000.

(51) Int. Cl.[7] ..... A63B 69/00; A63B 63/08; A63F 7/20

(52) U.S. Cl. ..... 473/447; 473/480; 473/481; 273/317.3

(58) Field of Search ..... 473/479, 480, 473/481, 483, 482, 447; 273/317, 317.3

(56) References Cited

U.S. PATENT DOCUMENTS 4,956,775 A * 9/1990 Klamer et al. ..... 473/480
5,305,998 A * 4/1994 Nesbit et al. ..... 473/481
5,346,207 A * 9/1994 Heinen ..... 473/481
5,375,103 A * 12/1994 Ulloa ..... 368/12
5,762,569 A * 6/1998 Hale ..... 473/480
5,916,048 A * 6/1999 Hurell et al. ..... 473/479

* cited by examiner

*Primary Examiner*—Paul T. Sewell
*Assistant Examiner*—Mitra Aryanpour
(74) *Attorney, Agent, or Firm*—Adam H. Jacobs

(57) ABSTRACT

An action-responsive basketball backboard includes a backboard having a rim mounted thereon. Mounted thereon are a rim motion sensor operative to detect specific motions of the rim and output notification signals signaling detection of those specific motions, and a backboard motion sensor operative to detect specific motions of the backboard and output notification signals signaling detection of those specific motions. At least one set of indicator lights is mounted on the backboard and a power supply for supplying electrical power to the set of indicator lights is connected thereto for lighting the lights. A control box having a controllable switch interposed between the power supply and the set of indicator lights is included, the control box in information transmission connection with the rim motion sensor and the backboard motion sensor, the control box operative to receive notification signals from the rim and backboard motion sensors.

7 Claims, 4 Drawing Sheets

ACTION-RESPONSIVE BASKETBALL BACKBOARD

CROSS-REFERENCE TO RELATED APPLICATION

This application claims priority to the filing date of a related provisional application serial No. 60/241,586 filed Oct. 19, 2000.

BACKGROUND OF THE INVENTION

1. Technical Field

The present invention relates to basketball backboards and, more particularly, to a lighted, action-responsive basketball backboard which includes a plurality of sensing devices mounted on the rim and backboard, a control box operative to receive signals from the sensors and at least one set of lights operatively connected to the control box which are illuminated in response to actions detected by the sensors.

2. Description of the Prior Art

Basketball is one of the most popular sports in the world. The high-flying players, the non-stop action and the spectacular athleticism are only a few of the reasons why basketball is such a popular spectator sport, but obviously the millions of amateur players who find excitement and enjoyment in the action and exercise have additional reasons why they play. Although many of the players do enjoy the sport whether or not they are able to play "above the rim," there are others, particularly young players, who see the amazing exploits of professionals on television and wish that they could duplicate them in their own backyard or on their driveway. Obviously, the vast majority of players cannot dunk like the professionals or college players, so younger players often will drop the basket down to enable dunking of the basketball. After playing on the lower rim for a while, however, the excitement wears off and some players lose interest in the game. For younger players, it is vital to retain their interest in the game and to increase the level of enjoyment if possible. There is therefore a need for a basketball rim and backboard which will increase the level of excitement available during play.

Much of the excitement of a dunk is the sound generated by the power of the dunk. Unfortunately, the vast majority of basketball players cannot generate the necessary height or power to produce the desired sound, thus energizing his or her teammates and the crowd. It is believed that the excitement level would be increased by including a sound-generating device which generates sounds in response to specific activities taking place on the backboard or rim. It is further believed that even greater excitement would be generated by the inclusion of light-generating devices which likewise signal the occurrence of specific events on the backboard or rim, such as dunks or the like. There is therefore a need for an action-responsive basketball backboard which will generate sound and light in response to a dunk or other activity, thereby increasing the excitement and enjoyment of the activity.

Many basketball teams have specific team names or logos associated therewith. The fans of these teams have strong ties to the team and exhibit excitement in response to their team playing well. These fans are the most excited when one of the team's players performs a spectacular dunk or other such outstanding play. However, it is believed that the fans' enjoyment of the specific play will be enhanced by the lighting of the team name or logo in response to such a dunk, and there is therefore a need for an action-responsive basketball backboard which includes an arrangement of lights thereon in the shape of a team's name or logo, the name or logo lighting up in response to specific activity taking place such as a dunk or the like, thus generating additional excitement in fans and spectators.

Therefore, an object of the present invention is to provide an action-responsive basketball backboard.

Another object of the present invention is to provide an action-responsive basketball backboard which includes a backboard having a rim mounted thereon, the backboard including at least one set of indicator lights which will light up in response to specific movements of the rim and backboard.

Another object of the present invention is to provide an action-responsive basketball backboard having a rim movement sensor and a backboard movement sensor for sensing and signaling specific movements of the rim and backboard.

Another object of the present invention is to provide an action-responsive basketball backboard which will provide immediate signaling of an event to provide instantaneous feedback to the player, thus increasing enjoyment and excitement.

Another object of the present invention is to provide an action-responsive basketball backboard which includes a control box which controls the lighting of the indicator lights in response to the specific movements of the rim and backboard.

Another object of the present invention is to provide an action-responsive basketball backboard which adds excitement to the playing of basketball, particularly for younger players.

Finally, an object of the present invention is to provide a action-responsive basketball backboard which is relatively simple to manufacture and which is safe and durable in use.

SUMMARY OF THE INVENTION

The present invention provides an action-responsive basketball backboard which includes a backboard having a rim mounted thereon. Mounted thereon are a rim motion sensor operative to detect specific motions of the rim and output notification signals signaling detection of those specific motions, and a backboard motion sensor operative to detect specific motions of the backboard and output notification signals signaling detection of those specific motions. At least one set of indicator lights is mounted on the backboard and a power supply for supplying electrical power to the set of indicator lights is connected thereto for lighting the lights. A control box having a controllable switch interposed between the power supply and the set of indicator lights is included, the control box in information transmission connection with the rim. motion sensor and. the backboard motion sensor, the control box operative to receive notification signals from the rim and backboard motion sensors and alternatively engage and disengage the controllable switch to light the set of indicator lights in response to motion detection by the rim and backboard motion sensors.

The action-responsive basketball backboard as thus described clearly offers several advantages over those devices found in the prior art. The relatively simple design of the action-responsive basketball backboard ensures that the unit will function properly for an extended lifetime. Also, because the present invention can include a number of different light designs or can also include a sound-emitting device, the present invention can significantly increase the enjoyment and excitement of playing basketball for players of all ages and all skill levels. Furthermore, as the present invention will be relatively inexpensive to manufacture, it will be usable and purchasable by persons of many different income levels. Finally, the action-responsive basketball backboard of the present invention is safe and durable in use, and this makes the backboard safe for use by even small children. The present invention thus provides a substantial improvement over those devices found in the prior art.

DESCRIPTION OF THE PREFERRED EMBODIMENT

Figure 1:
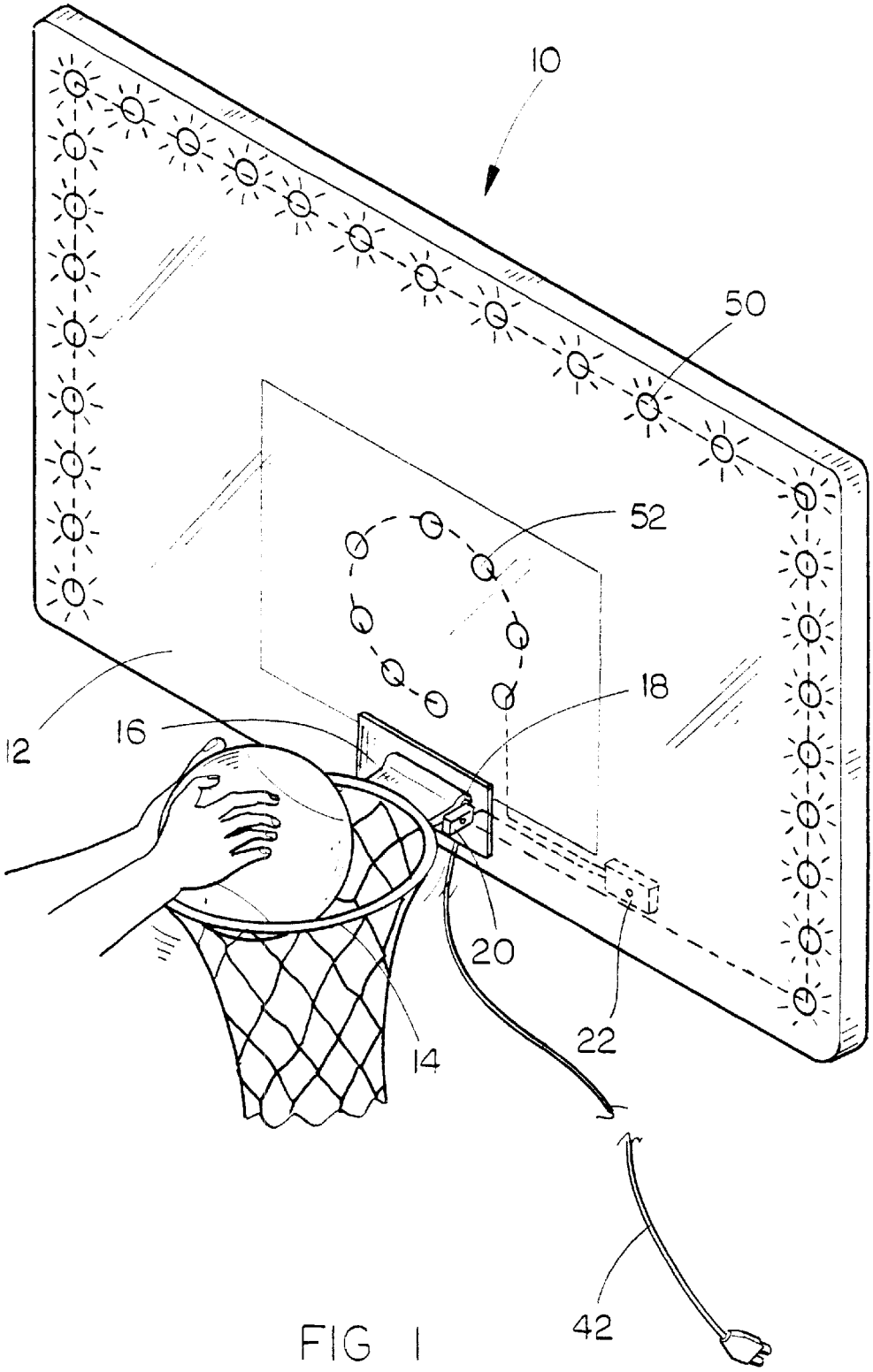
FIG. 1 is a perspective view of the lighted, action-responsive basketball backboard of the present invention showing the outer lights lighting in response to a dunk.
Figure 2:
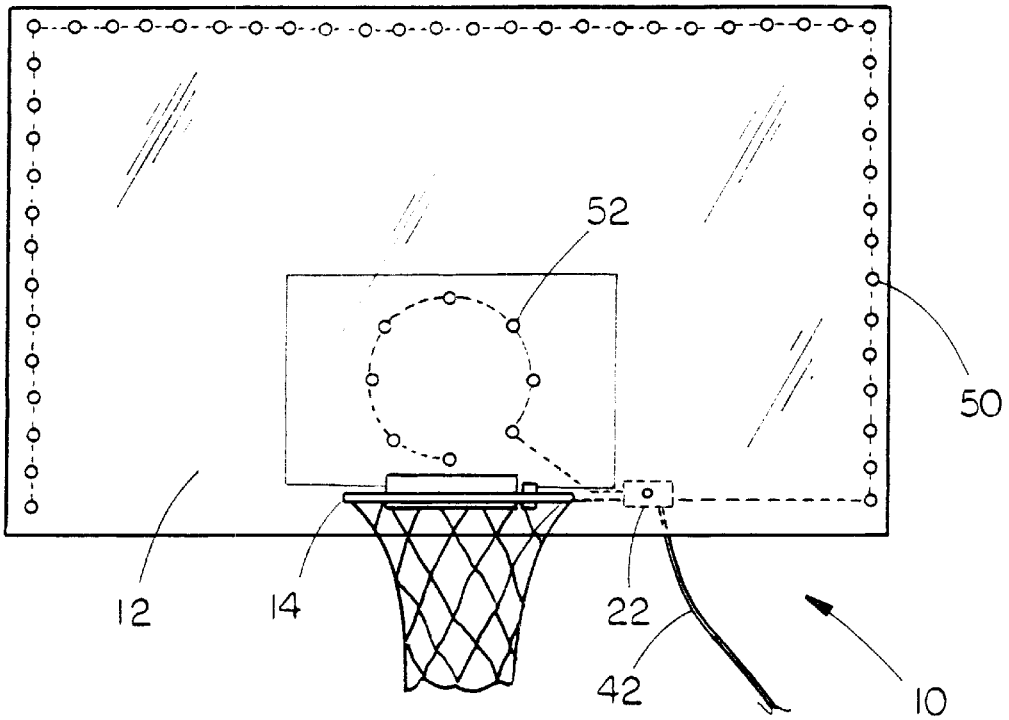
FIG. 2 is a front elevational view of the backboard of the present invention showing the sets of lights prior to being illuminated in response to action detected.
Figure 3:
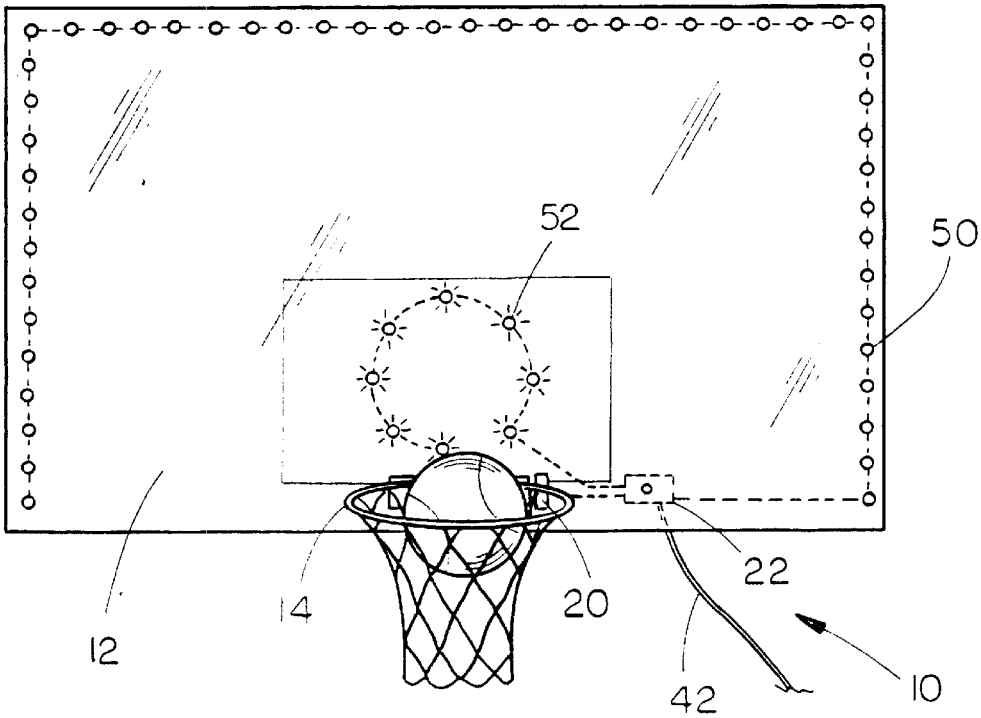
FIG. 3 is a front elevational view of the backboard showing the inner set of lights being illuminated in response to a different action being detected.

The lighted, action-responsive basketball backboard 10 of the present invention is best shown in FIGS. 1–3 as including a generally rectangular transparent backboard 12 which would preferably be constructed of plexiglass or another such plastic substance. Mounted to the front of the backboard 12 is a basketball rim 14 which includes a breakaway hinge 16 which permits the rim 14 to be pivoted downwards in response to force being applied thereto, such as during a dunk or the like. The hinge 16 is biased upwards by a spring 18 in the manner commonly understood in the art.

In the preferred embodiment, the present invention would include either two or three sensing devices, the third sensing device being optional. The first sensing device would be a rim pivot sensor 20, which would be mounted adjacent to breakaway hinge 16 and would detect the degree of movement of breakaway hinge 16 relative to its rest position. Preferably, rim pivot sensor 20 would be a resistance-variable sensor which returns a value of zero when the rim is in rest position and returns proportionally increasing values corresponding to motion detection depending upon the degree of pivot of the breakaway hinge 16. The signals would be sent via a wire or other connection to control box 40, which will be discussed later in this disclosure.

The second sensor provided in the present invention is a backboard motion detector 22 which would preferably be mounted on the back of backboard 12 adjacent the lower edge thereof and would be a vibration and motion sensor which would return a value of zero when the backboard is at rest and would return greater values depending upon the degree of vibration and/or motion in the backboard 12 during game play. The backboard motion detector 22 would be operatively connected to control box 40 to permit transfer of detection information therefrom.

Figure 4:
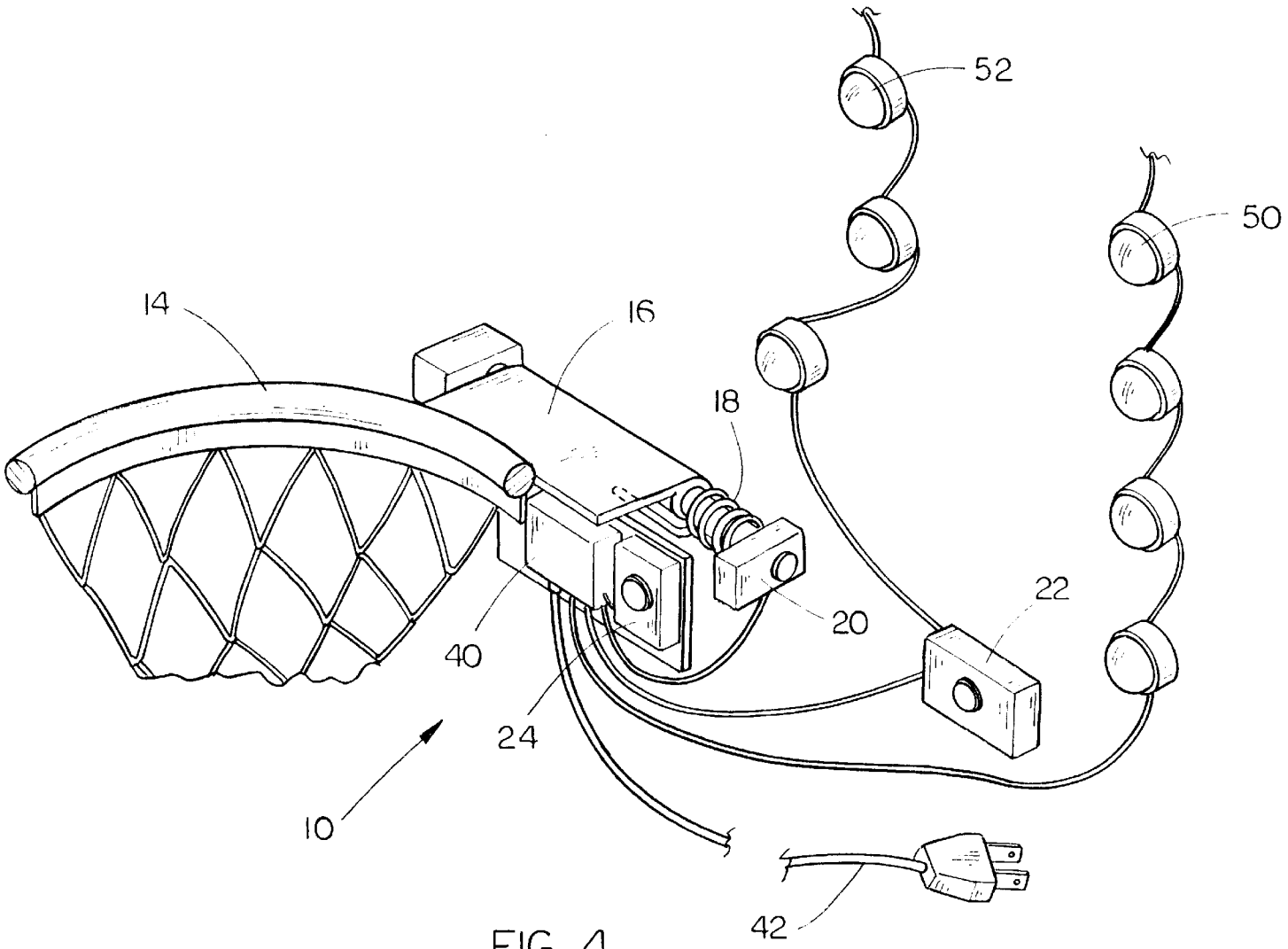
FIG. 4 is a detail perspective view of the control box and sensors of the present invention.

Finally, the optional third sensor would be a shot detection sensor 24, shown best in FIG. 4, which would be mounted adjacent basketball rim 14 to detect the making of a shot through rim 14. Shot detection sensors such as that used with the present invention are known in the prior art and shot detection sensor 24 would be operatively connected to control box 40 for information transfer between shot detection sensor 24 and control box 40.

Figure 5:
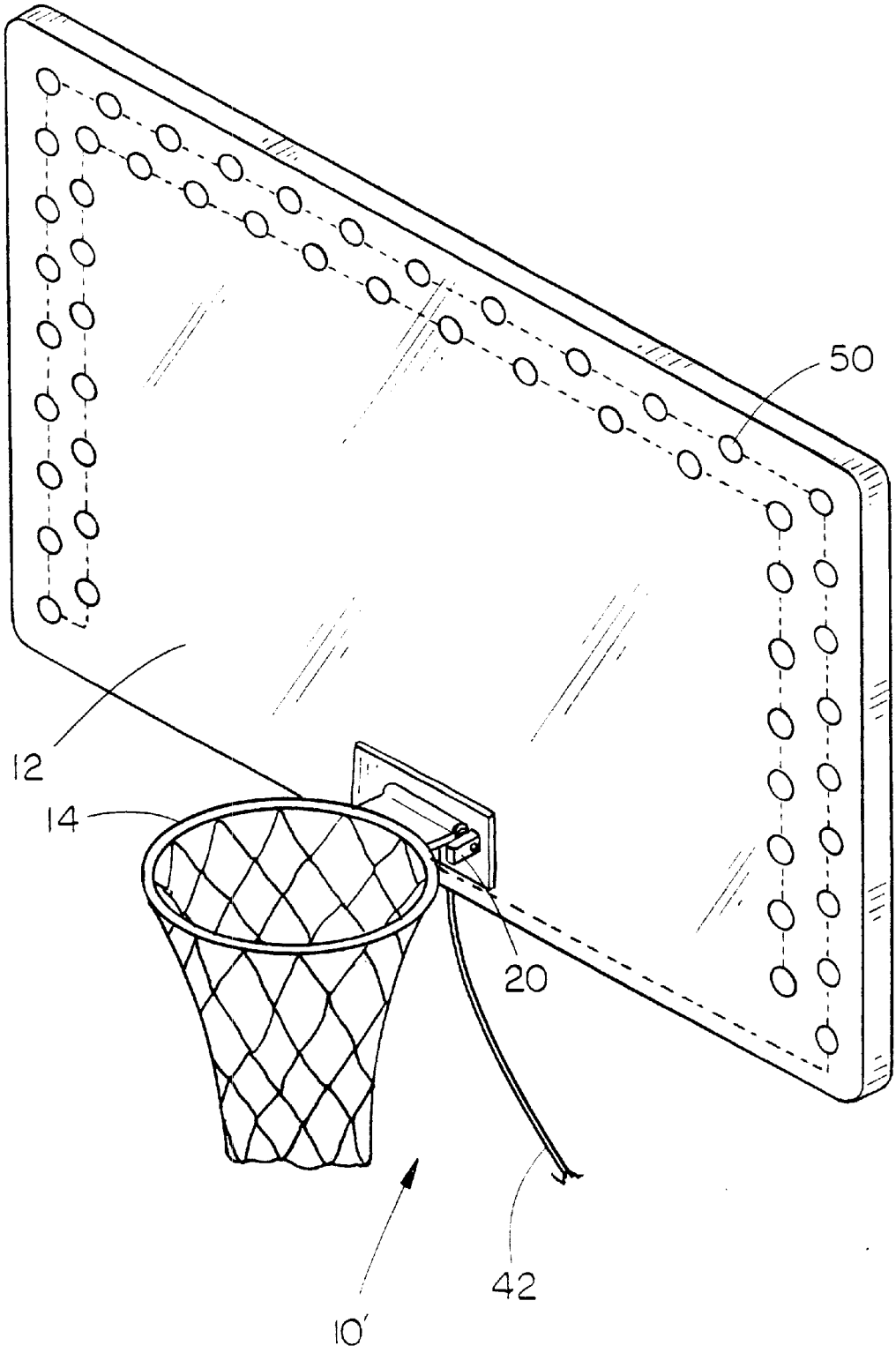
FIG. 5 is a perspective view of an alternative embodiment of the present invention showing a different light arrangement.

In the preferred embodiment, the present invention would also include at least one set of indicator lights 50 arranged behind the backboard 12 and mounted thereon such that the lights may be viewed through backboard 12 due to the transparency thereof. While the arrangement of lights 50 is shown as surrounding the backboard adjacent the periphery thereof, it should be understood that a virtually unlimited number of configurations of lights may be used with the present invention to signify event occurrences, such as lights arranged in the shape of a team's logo or name, or in other arrangements such as that shown in FIG. 5. In the embodiment shown in FIGS. 1–3 a second set of lights 52 would be mounted inside of the outer grouping of lights 50 for signifying occurrence of a different event during game play. The outer lights 50 and inner lights 52 are preferably connected within each group in parallel to ensure that the burnout of one light will not prevent the lighting of the other lights, and the terminus of each of the connections is connected to control box 40 in an electrically conductive manner. Also feeding into control box 40 would be an external power source such as a cord 42 plugged into a standard household outlet or the like, although the exact nature of the connection is not critical to the present invention so long as power is supplied to the invention. In fact, it should be noted that any type of power-supplying device can be used with the present invention, such as batteries, solar power or the like, so long as the function of supplying power to the invention is maintained.

As stated previously, control box 40 is connected in information transmission connection with the rim pivot sensor 20, backboard motion detector 22 and shot detection sensor 24 and is electrically connected to outer and inner lights 50 and 52, as shown best in FIG. 4. Control box 40 controls the illumination of outer and inner lights 50 and 52 in the following manner. When basketball rim 14 is pivoted on breakaway hinge 16, rim pivot sensor 20 sends a signal to control box 40 which contains information concerning the amount of rotation of breakaway hinge 16. This information is translated by control box 40 which engages a rheostat, a controllable switch or the like to permit power to flow to outer lights 50 thereby lighting outer lights 50 to the degree corresponding to the amount or rotation of breakaway hinge 16. For example, when breakaway hinge 16 rotates only slightly as during a jump shot or weak dunk, outer lights 50 would be illuminated only weakly or, alternatively, not all of the outer lights 50 would be illuminated, but when breakaway hinge 16 is rotated excessively, as during an extremely powerful dunk, control box 40 would illuminate outer lights 50 to the greatest degree possible, or illuminate all of the lights at the same time. Game action is thus translated to a visual display shown by the lights 50. It should be noted that the control box 40 can include such relatively simple mechanical switching devices as described above, or can include a programmable microprocessor which is programmed to control switches for feeding power to the lights. Such programming is known in the field of art and does not specifically constitute the inventive element of the invention, rather it is the unique use and elements of the combination which provide the inventive features of the present invention.

Correspondingly, activation of backboard motion detector 22 would result in transfer of information to control box 40 in the same manner as described in connection with rim pivot sensor 20, thus commanding control box 40 to light inner lights 52 to varying degrees of illumination and/or amount which would signify the occurrence of a minor vibration of the backboard or, on the other extreme, a "rim-rattling" dunk.

Finally, activation of shot detection sensor 24 would light a corresponding light, be it outer lights 50, inner lights 52 or other associated lights which would be affixed to the rear of transparent backboard 12. In this manner, activity taking place during play is translated into a visual display of the action, thus increasing the enjoyment of the game and highlighting selected actions which take place.

Of course, it is to be understood that numerous modifications, additions and substitutions may be made to the lighted, action-responsive basketball backboard 10 of the present invention. For example, various other actions may be sensed by sensors affixed to the backboard and/or rim, the information then being transferred to the control box 40, which would be programmed to illuminate sets of lights in response to those actions. Also, the types of sensors used, exact specifications of the control box and arrangement and types of lights used may be modified and/or changed yet still fall within the intended broad description of the invention. Furthermore, it is to be understood that the sensors, via the control box 40, may be connected to other types of devices such as sirens, horns and other lighting devices, all of which would be used to enhance game play and add excitement to the action taking place on the basketball court. Finally, the construction materials used and dimensions of the present invention may be modified or changed so long as the intended functionality of the present invention is not substantially modified or destroyed. For example, the backboard may be non-transparent and instead include inlaid lights on the front face thereof which would produce the same effects as previously described.

There has thus be shown and described a lighted, action-responsive basketball backboard which accomplishes at least all of its intended objectives.

I claim:

1. An action-responsive basketball backboard comprising:

a backboard having a rim mounted thereon;

a rim motion sensor mounted on one of said backboard and said rim, said rim motion sensor operative to detect specific motions of said rim and output notification signals signaling detection of those specific motions;

a backboard motion sensor mounted on one of said backboard and said rim, said backboard motion sensor operative to detect specific motions of said backboard and output notification signals signaling detection of those specific motions;

at least one set of indicator lights mounted on said backboard;

power means for supplying electrical power to said at least one set of indicator lights;

a control box having a controllable switch means interposed between said power means and said at least one set of indicator lights, said control box in information transmission connection with said rim motion sensor and said backboard motion sensor, said control box operative to receive notification signals from said rim and backboard motion sensors and engage said controllable switch means to light said at least one set of indicator lights in response to motion detection by said rim and backboard motion sensors.

2. The action-responsive basketball backboard of claim 1 wherein said rim is pivotably mounted on said backboard by a breakaway hinge such that said rim is pivotable downwards from a generally horizontal rest position in response to force applied thereto.

3. The action-responsive basketball backboard of claim 2 wherein said rim pivot sensor comprises a resistance-variable sensor which returns a value of zero when said rim is in said rest position and returns proportionally increasing values corresponding to motion detection depending upon the degree of downwards pivot of said rim.

4. The action-responsive basketball backboard of claim 3 wherein said backboard motion detector is mounted on the rear of said backboard and comprises a vibration and motion sensor which would return a value of zero when the backboard is at rest and would return greater values depending upon the degree of vibration and/or motion of said backboard.

5. The action-responsive basketball backboard of claim 4 comprising at least two sets of indicator lights, at least one first set related to said rim motion detector and at least one second set related to said backboard motion detector such that upon said rim motion detector detecting motion of said rim, said rim motion detector signals said control box to engage said at least one first set of indicator lights to visually display motion of said rim, and upon said backboard motion detector detecting motion of said backboard, said backboard motion detector signals said control box to engage said at least one second set of indicator lights to visually display motion of said backboard.

6. The action-responsive basketball backboard of claim 1 wherein said control box comprises light control means selected from the group comprising a rheostat, a controllable switch and a microprocessor.

7. An action-responsive basketball backboard comprising:

a backboard having a downwardly pivotably mounted breakaway rim mounted thereon;

a rim motion sensor mounted on one of said backboard and said breakaway rim, said rim motion sensor operative to detect downward pivoting motion of said breakaway rim and output notification signals signaling detection of downward pivoting motion of said breakaway rim and the amount thereof;

a backboard motion sensor mounted on one of said backboard and said rim, said backboard motion sensor operative to detect vibrational motions of said backboard and output notification signals signaling detection of vibrational motions and the intensity thereof;

at least one first set of indicator lights mounted on said backboard;

at least one second set of indicator lights mounted on said backboard;

power means for supplying electrical power to said at least one first set and at least one second set of indicator lights;

a control box having at least two controllable switch means, a first controllable switch means interposed between said power means and said at least one first set of indicator lights, a second controllable switch means interposed between said power means and said at least one second set of indicator lights, said control box in information transmission connection with said rim motion sensor and said backboard motion sensor;

said control box operative to receive notification signals from said rim motion sensor and engage said first controllable switch means to light said at least one first set of indicator lights in proportional response to the amount of pivoting motion of said rim, said control box operative to receive notification signals from said backboard motion sensor and engage said second controllable switch means to light said at least one second set of indicator lights in proportional response to the intensity of vibrating motion of said backboard.

* * * * *